US006340314B1

(12) United States Patent
Kuo

(10) Patent No.: US 6,340,314 B1
(45) Date of Patent: Jan. 22, 2002

(54) ELECTRICAL ADAPTER

(75) Inventor: Yu-Jen Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/852,099

(22) Filed: May 8, 2001

(30) Foreign Application Priority Data

Dec. 21, 2000 (TW) ..... 089222265 U

(51) Int. Cl.[7] ..... H01R 25/00
(52) U.S. Cl. ..... 439/638; 439/49; 439/654
(58) Field of Search ..... 439/638, 654, 439/651, 652, 660, 49

(56) References Cited

U.S. PATENT DOCUMENTS 3,327,174 A * 6/1967 Barre et al. ..... 439/49
5,599,595 A * 2/1997 McGinley et al. ..... 439/638
5,827,092 A * 10/1998 Minich ..... 439/638

* cited by examiner

*Primary Examiner*—Tho D. Ta
(74) *Attorney, Agent, or Firm*—Wei Te Chung

(57) ABSTRACT

An electrical adapter (3) includes a first connector (1) having a number of terminals (10), a second connector (2) having a number of pins (20), and an insulating shell member (30) covering a junction portion where the first connector and the second connector are interconnected. Each terminal or pin has a contacting portion (140, 240) for mating with a contact of a complementary connector and a soldering portion (142, 242). Selected sddering portions of the terminals and the pins are soldered with each other to make respective electrical connections. Some of the terminals or the pins are curved for being soldered directly with corresponding terminals or pins in accordance with the need of desired signal transmission, thereby achieving a cost-effective and easy-processing adapter.

10 Claims, 4 Drawing Sheets

ELECTRICAL ADAPTER

BACKGROUND OF THE INVENTION

1. Field of the Invention

The present invention relates to an electrical adapter, and particularly to an electrical adapter constructed by permanently connecting two electrical connectors of different interfaces and terminal/pin arrangements.

2. Description of Related Art

IEEE 1394 electrical connectors are widely used in making electrical connections between computers and their peripheral multi-media devices such as digital monitors, etc. In different applications, IEEE 1394 connectors usually have different interfaces. Thus, an adapter is required to mate with different IEEE 1394 connectors when an electrical connection between two types of electrical equipments is needed. The adapter includes two IEEE 1394 connectors in both ends thereof which can respectively mate with IEEE 1394 connectors of different electronic devices. The connectors of the adapter are usually interconnected by bundle of wires, discrete conducting wires, or printed circuit boards. The conductors of wires for interconnection should be soldered to terminals of the connectors of the adapter. However, the character of the wires is so supple that it adds difficulties to the soldering procedure. Therefore, the production efficiency is decreased and the production procedure is complicated. Moreover, the use of wires will influence the quality of data during signal transmission.

Hence, an improved adapter is desired.

SUMMARY OF THE INVENTION

Accordingly, one object of the present invention is to provide an improved adapter which can be manufactured easily and cost-effectively.

In order to achieve the object set forth, an adapter, used for mating respectively with connectors having different interfaces, comprises a first connector with a plurality of terminals, a second connector with a plurality of pins, and an insulating case covering a junction portion where the first connector and the second connector are interconnected. Each terminal or pin has a contacting portion for electrically connecting with corresponding contact of a complementary connector and a soldering portion. Where arrangements of the terminals and the pins are not aligned, some terminals or pins on one connector are curved for being soldered directly with the corresponding terminals or pins on the other connector.

Other objects, advantages and novel features of the invention will become more apparent from the following detailed description when taken in conjunction with the accompanying drawings.

DETAILED DESCRIPTION OF THE INVENTION

Figure 1:
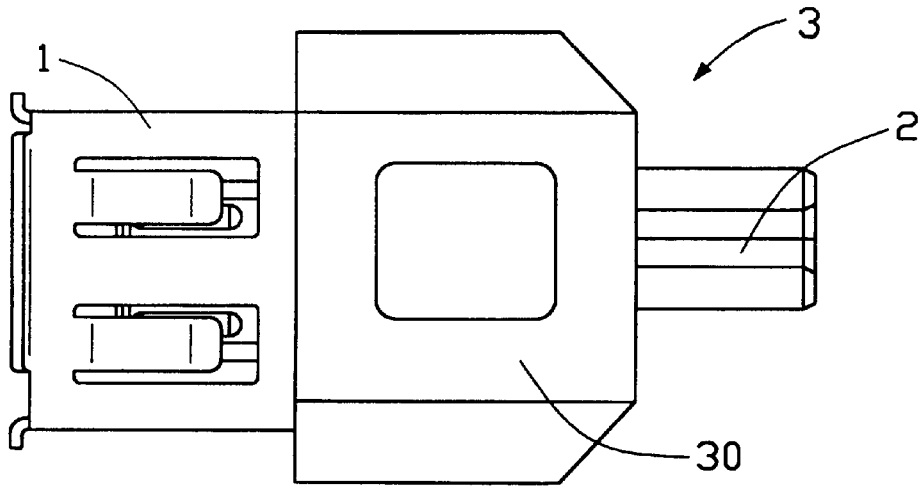
FIG. 1 is a top view of an adapter in accordance with the present invention.

Reference will now be made to the drawing figures to describe the present invention in detail.

Figure 2:
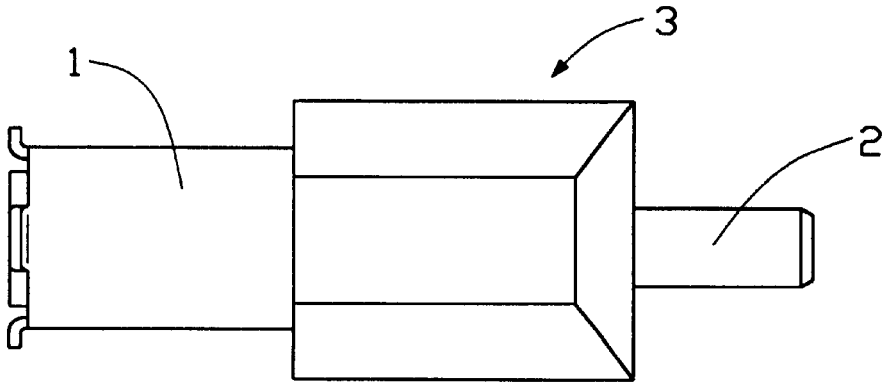
FIG. 2 is a side view of FIG. 1.
Figure 3:
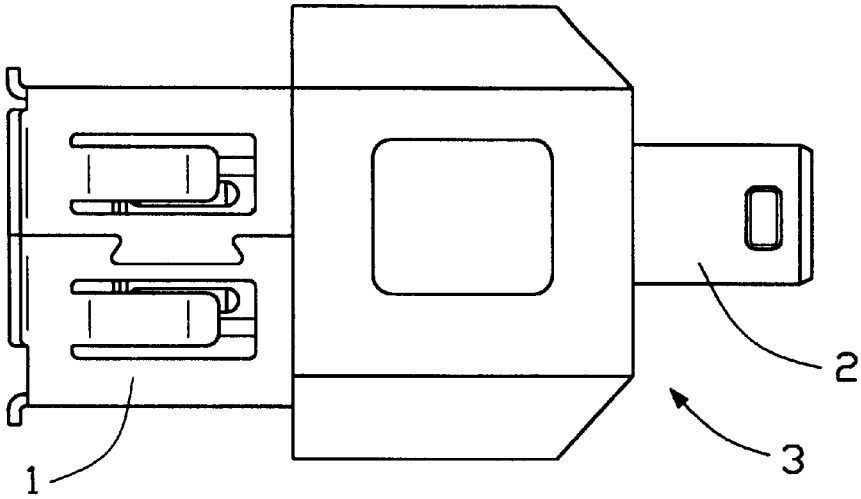
FIG. 3 is a bottom view of FIG. 1.

Referring to FIGS. 1–3, an adapter 3 in accordance with the present invention comprises a first connector 1, a second connector 2 and an insulating case 30 covering a junction portion between the first connector 1 and the second connector 2.

Figure 4:
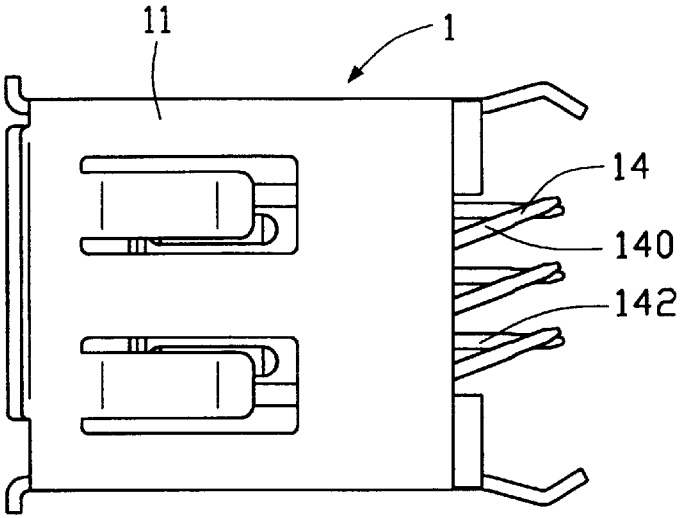
FIG. 4 is a top view of a first connector of the adapter.
Figure 6:
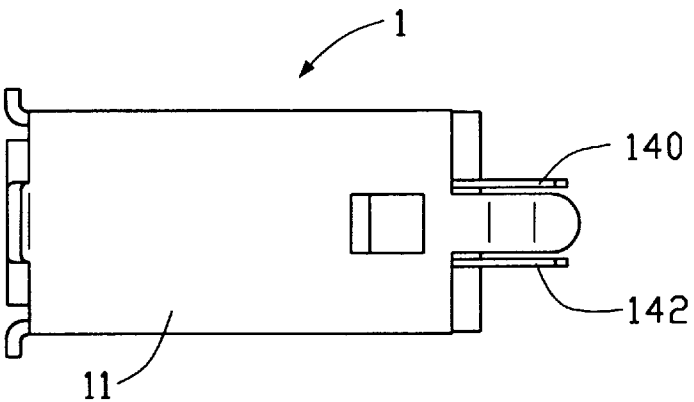
FIG. 6 is a side view of FIG. 4.
Figure 5:
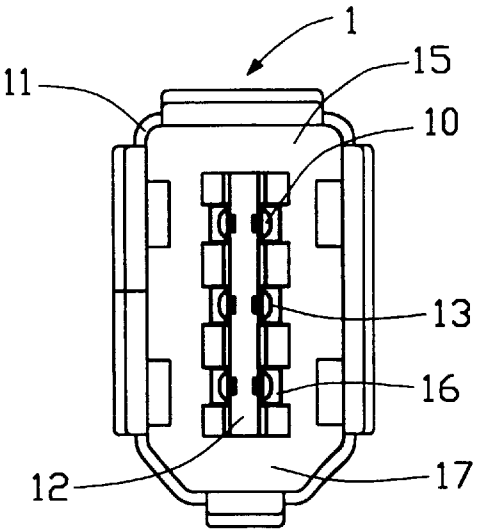
FIG. 5 is a front view of FIG. 4.
Figure 8:
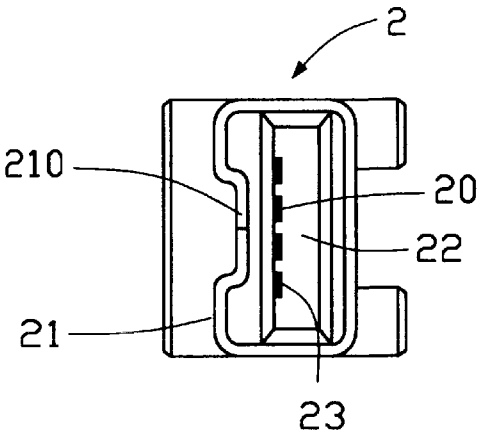
FIG. 8 is a front view of FIG. 7.
Figure 7:
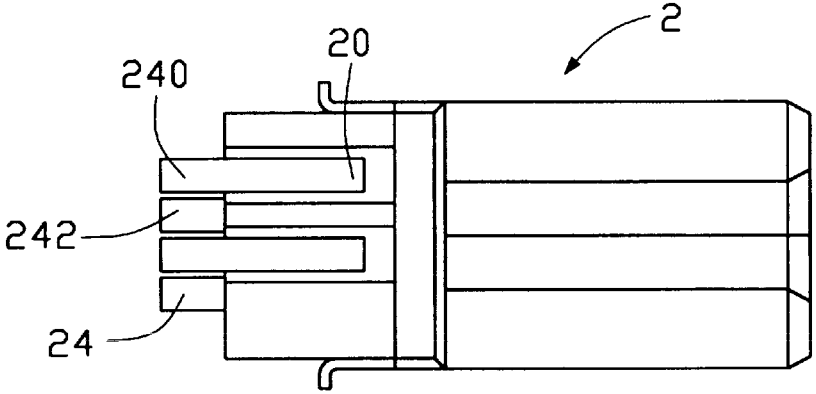
FIG. 7 is a top view of a second connector of the adapter.
Figure 9:
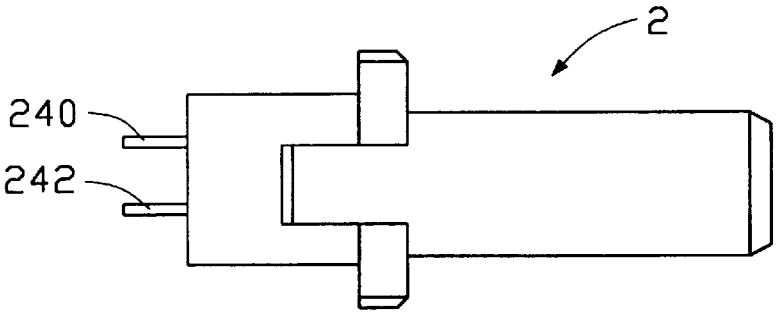
FIG. 9 is a side view of FIG. 7.

Referring to FIGS. 4–6, in an embodiment of the present invention, the first connector 1 of the adapter 3 is configured as an IEEE 1394 socket connector with six terminals 10 thereon. The first connector 1 comprises a dielectric housing 17, a first shell member 11 enclosing the housing 17 and the terminals 10. The first shell member 11 defined a receptacle cavity 15 surrounded by top, bottom and sidewalls which are shaped to accommodate an IEEE 1394 plug connector (not shown). A mating tongue 12 of the housing 17 is projected within the cavity 15 and defines six passageways 16 on both sides thereof. The terminals 10 of the first connector 1 each have a contacting portion 13 at one end thereof to be received in the corresponding passageway 16 and a soldering portion 14 at the other end thereof extending out of the shell member 11 and are arranged in two rows. One row is first soldering portions 140which are extending upwards and rightwards as viewed from FIG. 4, while the other row is second soldering portions 142 which are extending rightwards straightforwardly. The terminals 10 in each row are parallel to each other. Referring to FIGS. 7–9, the second connector 2 is configured as an IEEE 1394 plug connector with four pins 20 received therein. A second shell member 21 of the second connector 2 encloses a support tongue 22 which contains four pins 20 therein. A mating orientation key 210 is formed at a side of the second shell member 21 opposite to the support tongue 22 for ensuring correct polarity of a mating complementary connector (not shown). The pins 20 of the second connector 2 extend parallelly and each have a contacting portion 23 for electrically connecting with corresponding contact of the mating connector and a soldering portion 24. The four pins 20 are arranged in two rows for being soldered with terminals 10 of the first connector 1. One row of the pins 20 is first soldering portions 240 and the other row is second soldering portions 242.

Figure 10:
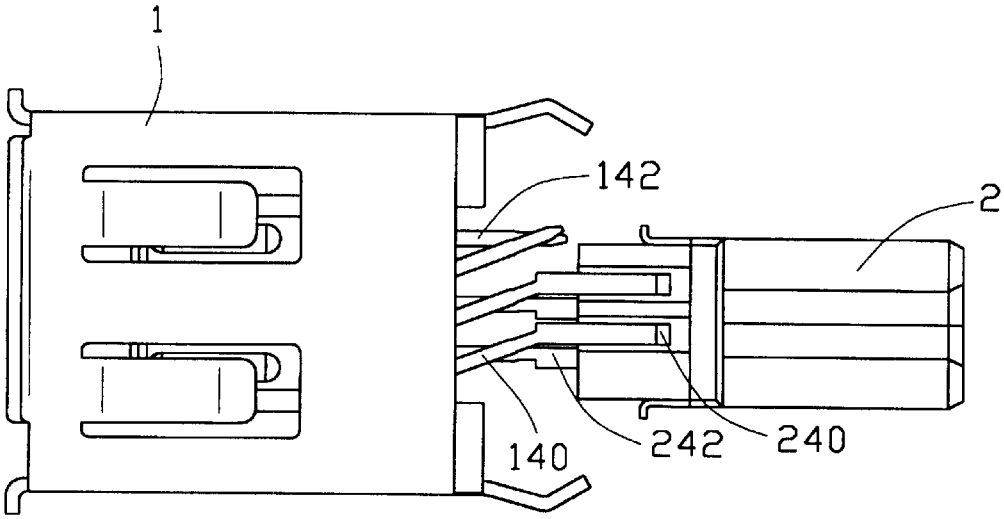
FIG. 10 is a top view with an insulating case removed to show how soldering portions of terminals in the first connector are soldered with soldering portions of pins in the second connector.
Figure 11:
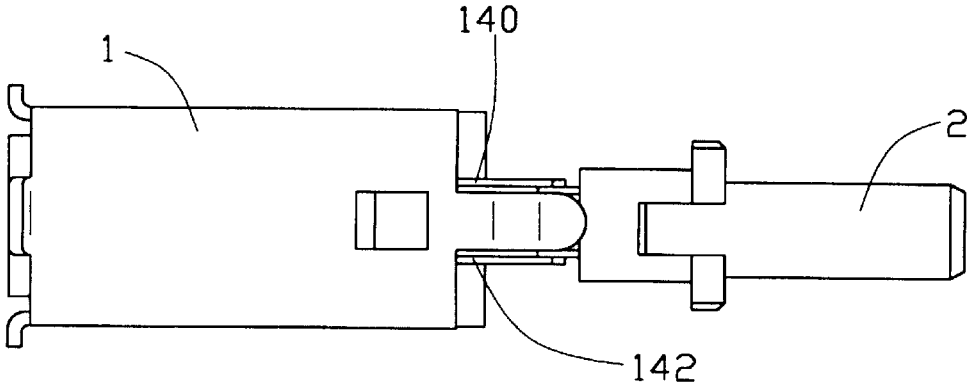
FIG. 11 is a side view of FIG. 10.
Figure 12:
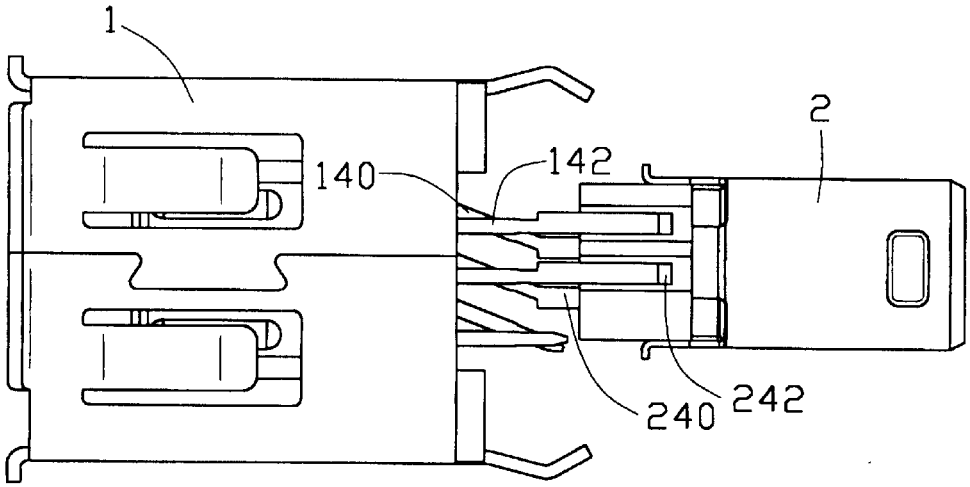
FIG. 12 is a bottom view of FIG. 10.

Referring to FIGS. 10–12, in assembly, the first soldering portions 140 of the terminals 10 in the first connector 1 are soldered with the first soldering portions 240 of the pins 20 in the second connector 2, and the second soldering portions 142 of the terminals 10 in the first connector 1 are soldered with the second soldering portions 242 of the pins 20 in the second connector 2, respectively. The uppermost two terminals 10 of the first connector 1 are used for transmitting power and need not to be soldered to the second connector 2. Then, the insulating case 30 is insert molded or attached in any suitable known means to the junction portion in which the first connector 1 and the second connector 2 are interconnected. Thus, the adapter 3 in accordance with the present invention is achieved.

An electrical connection between the first and the second connectors 1, 2 is attained by soldering the terminals 10 with the pins 20 directly, which reduces not only the trace for transmitting signals but also the size of the adapter 3. Namely, the quality of signals is improved and the cost of products is decreased.

It can be understood that the first connector 1 originally defines two rows of terminals 10 by pairs while being offset from each other. If the solder portions 142 of the more number terminals 10in both two rows keep straight and soldered to the solder portions 240 of the corresponding less number pins 20 of the second connector 2 under the condition that the second connector 2 is generally located around the middle portion of the first connector 1, the unsoldered free terminals 10 will then be respectively located at two opposite ends. Because the free terminals are designed as the power terminals which are expected to be by pair(s) and close to each other, this far spatial arrangement for these free terminals is not acceptable. Oppositely, if keeping one pair of outermost terminals free for the power transmission and soldering the rest with the pins of the second connector, the second connector can not generally located around the middle portion of the first connector and definitely will be offset from the first connector overall. This is also not desired by the industry. Differently and peculiarly, in the instant invention the solder portions of terminals in one row is obliquely deflected toward and close to the corresponding solder portions of the same pairs of terminals, respectively. Therefore, the pins of the second connector are soldered to the most deflected terminals and their corresponding pair partner, i.e., the corresponding straight one, while leaving the outmost pair free which is located at one end of the pairs of terminals where the deflected solder portions of the terminals direct to. Under this arrangement, the second connector can be located around the middle portion of the first connector, i.e., being self-symmetric relative to a center line of the first connector, and also leave one pair of terminals of the first connector for power transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

a first connector having a first shell member a housing enclosed by the first shell member, and a plurality of terminals received in the housing, each terminal having a contacting portion at one end thereof for mating with a corresponding contact of a complementary connector and a soldering portion at an opposite end thereof; and a second connector having a second shell member, a housing enclosed by the second shell member, and a plurality of pins received in the housing, each pin having a contacting portion at one end thereof for mating with a corresponding contact of a mating connector and a soldering portion at an opposite end thereof;

wherein the soldering portions of the second connector are respectively aligned with and soldered to individual ones of a selected number of soldering portions of the first connector for making respective electrical connections therebetween;

wherein the soldering portions of the first and the second connectors are respectively arranged in two staggered rows;

wherein one row of the soldering portions of the first connector are curved to be soldered directly with corresponding soldering portions of the second connector for making a respective electrical connection therebetween.

2. The electrical adapter as described in claim 1, further comprising an insulating case insert molded to a junction portion between the first connector and the second connector.

3. The electrical adapter as described in claim 1, wherein the number of terminals of the first connector is greater than the number of pins of the second connector.

4. The electrical adapter as described in claim 3, wherein the first connector and the second connector are respectively a socket connector having six terminals and a plug connector having four pins.

5. An electrical adapter comprising:

first and second connectors back to back connected to each other, the first connector including two rows of larger number terminals, said terminals arranged with pairs while being offset from each other in each pair, solder portions of the terminals in one row being straightly extending toward the second connector while solder portions of the other row being obliquely extending toward the second connector and toward partners of the same pairs, respectively;

the second connector including two rows of smaller number pins, said pins defining solder portions; wherein the solder portions of the pins of the second connector are soldered to the solder portions of the corresponding pairs of terminals of the first connector while leaving at least one outermost pair of terminals free for power transmission.

6. The adapter as described in claim 5, wherein said second connector is located around a middle portion of the first connector.

7. The adapter as described in claim 5, wherein said outermost pair is located at one end of said pairs of terminals where the obliquely extending solder portions point to.

8. The adapter as described in claim 5, wherein the pins of the second connector are arranged in pairs while being offset from each other in each pair.

9. The adapter as described in claim 8, wherein the obliquely deflected solder portion of the terminal extends from one side of the solder portion of the corresponding terminal of the same pair to and beyond the other side thereof.

10. The adapter as described in claim 8, wherein for the pair of terminals and the pair of pins which are respectively soldered to each other, the terminal with the straight solder portion is alignedand soldered to the corresponding pin, and the terminal with the obliquely extending solder portion and the corresponding pin are not aligned with each other while being respectively positioned by two sides of said aligned terminal and pins and connected to each other by said obliquely extending solder portion.

* * * * *